US005205410A

United States Patent [19]

Kuipers et al.

[11] Patent Number: 5,205,410

[45] Date of Patent: Apr. 27, 1993

[54] LOOSE-EGG TRANSPORT PANEL

[75] Inventors: Kenneth J. Kuipers, New Holland; William F. Smith, New Oxford, both of Pa.

[73] Assignee: Say Plastics, New Oxford, Pa.

[21] Appl. No.: 851,789

[22] Filed: Mar. 16, 1992

[51] Int. Cl.[5] ..... B65D 19/00; B65D 85/32

[52] U.S. Cl. ..... 206/386; 206/521.1; 217/26.5; D9/456

[58] Field of Search ..... D9/456, 341, 425; 206/521.1, 386; 220/508; 217/43 A, 26.5, 26, 27

[56] References Cited

U.S. PATENT DOCUMENTS

D. 281,231 11/1985 Cochran ..... D9/456
D. 281,955 12/1985 Moller ..... D9/456
1,943,667 1/1934 Guyer ..... 206/521.1

*Primary Examiner*—William I. Price

[57] ABSTRACT

A panel for use in an egg-stacking system in which loose eggs are held in a system mounted on a pallet for shipment by a truck or railroad, the panel being made of a high density synthetic resin having raised edges and a plurality of depressions in the surface of the panel, the depressions being positioned to lie between rows of eggs in the trays below the panel to lock the panel and the underlying stacks of eggs in the trays into a shift-resistant unit.

5 Claims, 5 Drawing Sheets

LOOSE-EGG TRANSPORT PANEL

BACKGROUND OF THE INVENTION

The invention relates to a high density synthetic plastic panel useful in improving the shipping safety of stacks of eggs in trays, everything mounted on a pallet, the whole system constituting a skid. The loose eggs are collected from the farmers who produce them and transported to a packing plant where the eggs are washed, candled, graded, and packed for shipment to retailers such as grocery stores and supermarkets. The loose eggs are placed in conventional trays which are then mounted one atop another to form a stack, usually of six trays. These trays are illustrated in U.S. Design Pat. No. 281,955. In the past, the panels used to separate stacks of eggs have been made of plywood of appropriate area having a half-round around the perimeter of the panel to prevent stacks of trays from sliding off the panel during the rough jouncing of truck or railroad shipment. Since a full pallet carries over 10,000 eggs, it can be seen that if one of these units crashes over, the resulting mess is unbelievable.

According, there is a need for a panel which locks the stacks of trays filled with eggs in position to minimize the chances of the egg-stacking system from separating into portions which can fall individually or which can overbalance the entire system.

It is the object of this invention to present a loose-egg shipping panel having locking lugs or depressions on the bottom of the panel to keep the panel from shifting on the stack of eggs below, while the molded perimeter of the panel holds the layer of eggs on top snugly in place.

SUMMARY OF THE INVENTION

The invention contemplates a loose-egg shipping panel having raised edges to prevent egg containing trays from sliding off the top of the panel. Embossed depressions at the top of the panel protrude through to the back of the panel, the depressions being positioned to lie between rows of eggs in the trays below the panel in order to lock the panel and the underlying stacks of eggs into a shift-resistant unit. Each panel is made of a high density synthetic plastic, such as polypropylene or ABS, but preferably polyethylene, for ease of washing and maintenance of the panel. As a preferred embodiment, each depression in the top of the panel has a hole therein for drainage of any liquids on the panel and to improve the circulation of air through a stack of eggs.

Normally, when a skid of eggs arrives at the egg processing center, it is immediately placed in cold storage. As space and time becomes available on the processing lines, the skids are removed from cold storage so that the eggs may be placed in the processing lines. All this means that there is even in the processing center substantial movement of the skids containing the 10,000 plus eggs per skid, the movement normally being carried out using fork trucks. Thus even in the processing center it can be seen that the structural integrity of a skid is important to prevent slippage, collapse, and other accidents to the skids. The panel of the present invention, and its ability to lock the units of the skid together, contributes greatly to the structural integrity of the skid.

DETAILED DESCRIPTION OF PREFERRED EMBODIMENTS

Figure 1:
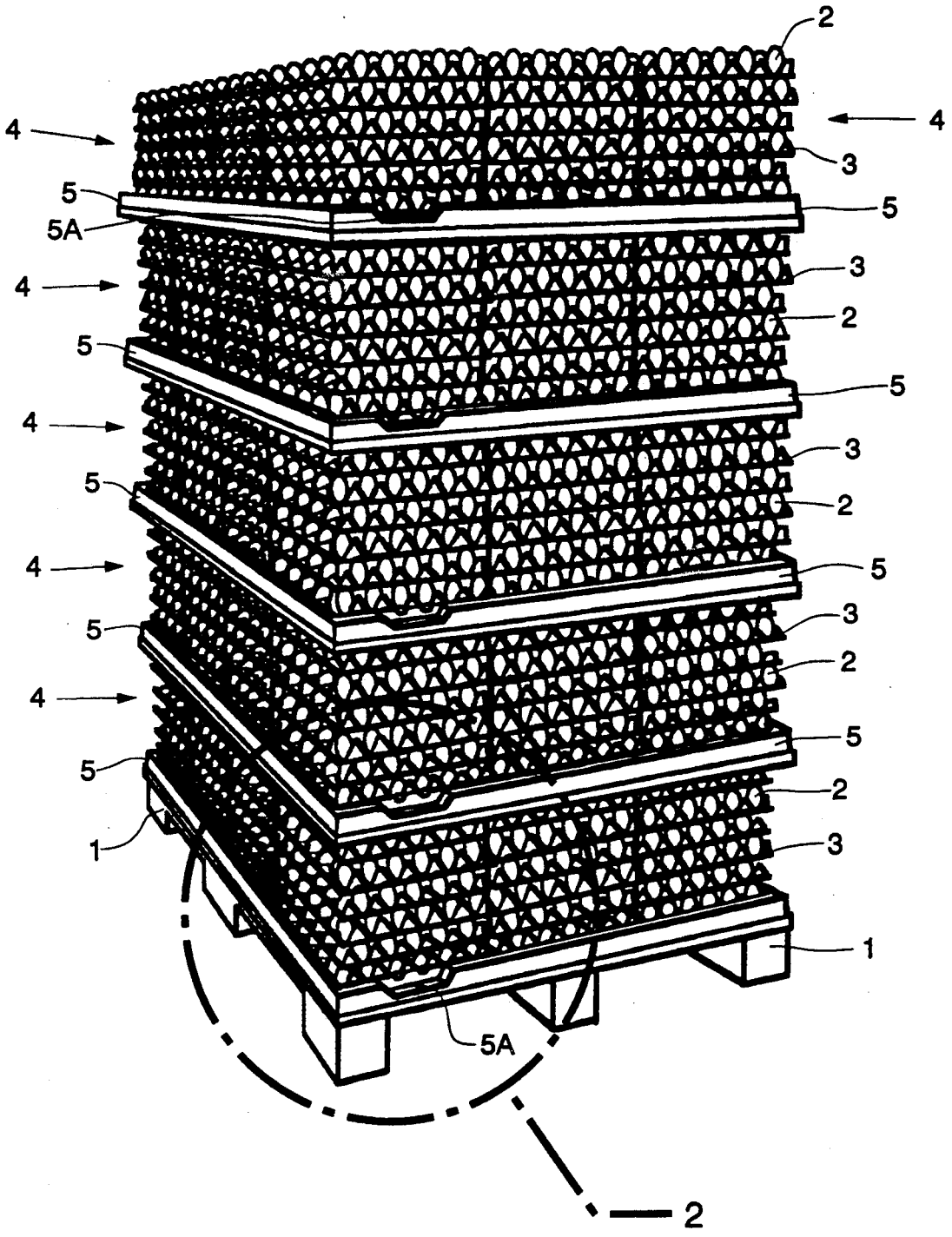
FIG. 1 shows a full egg-handling skid of 10,800 eggs utilizing five panels and 408 trays on a fork-lift pallet.
Figure 2:
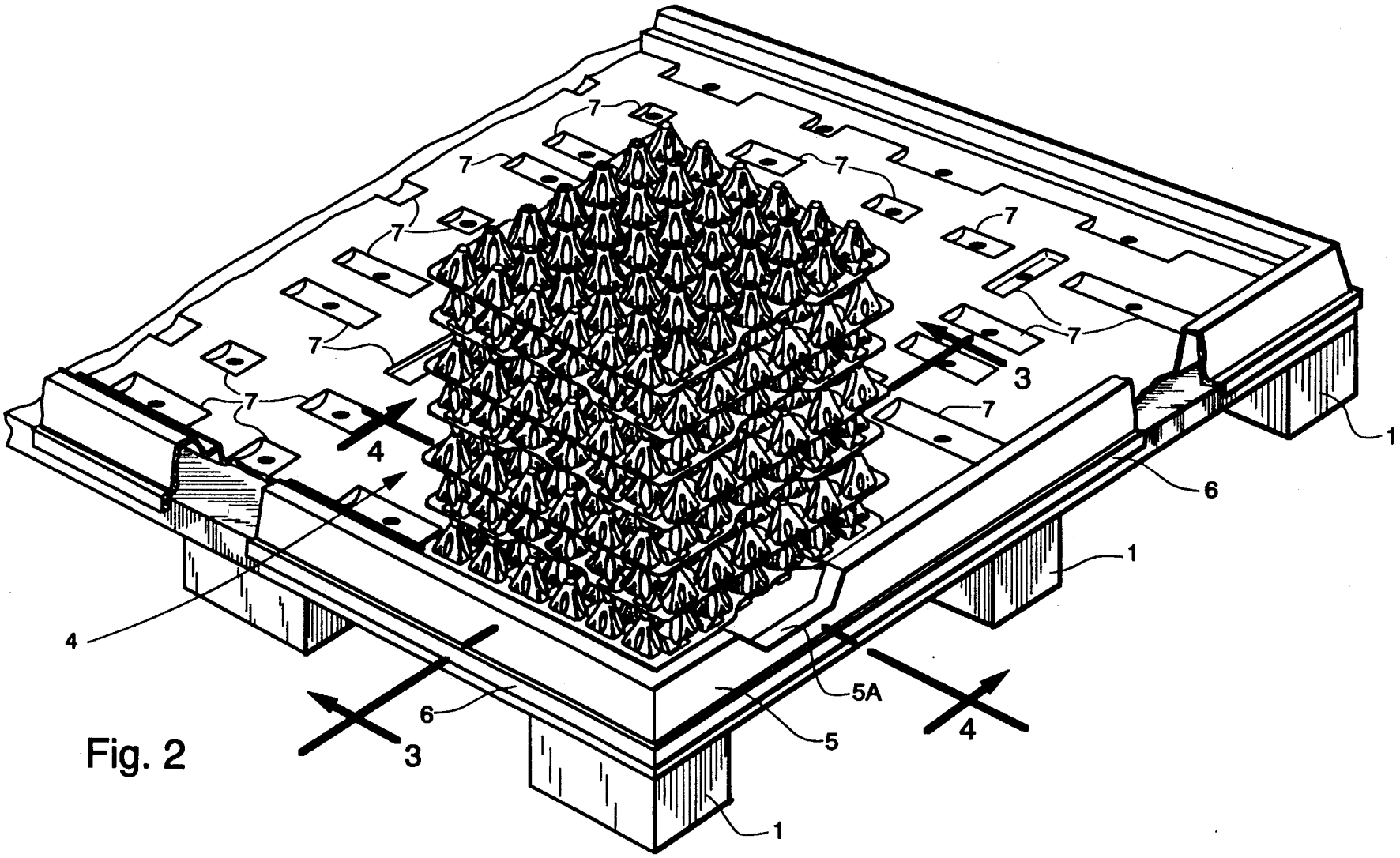
FIG. 2 is a fragmentary perspective of a portion of the skid of FIG. 1, the lower most panel and a corner stack of seven trays identified by a portion of the circle "2" in FIG. 1. The eggs have been omitted in FIG. 2.
Figure 3:
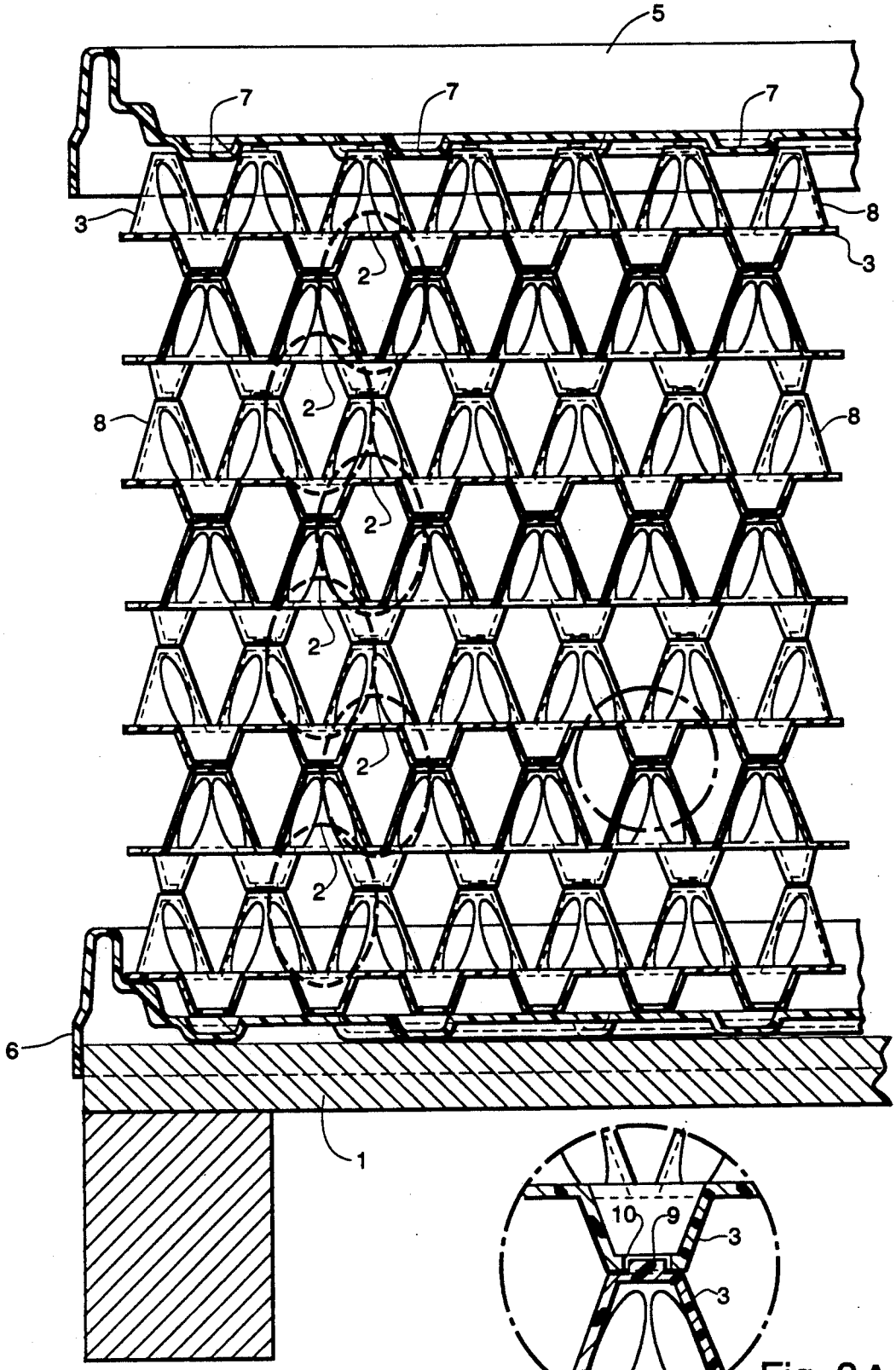
FIG. 3 is a section view through the stack of trays taken on the line 3—3 of FIG. 2 and showing how the bottom panel overlaps the pallet to lock the panel in place, and also showing how the depressions in the underside of the top panel fit between adjacent egg-cradling pylons of the top tray of the stack, and showing, in enlargement "A," how the buttons of each tray interlock with holes in the tray above it.
Figure 3A:
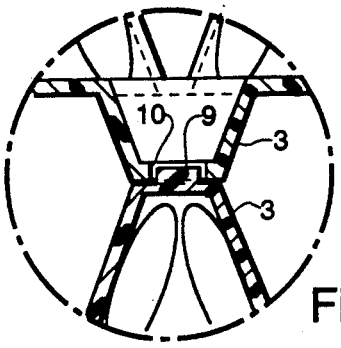

Referring to FIG. 1, the pallet 1 suitable for use with a fork-lift truck supports over 10,000 eggs 2 arranged in trays 3 mounted one atop another 4, the stacks 4 separated by panels 5 having hand-hold openings 5A. In FIG. 2, the panel 5 is shown mounted on the pallet 1 and in which the edges 6 of the panel 5 overlap and lock on the pallet 1. A single stack 4 not containing any eggs is shown positioned at one corner of the panel 5. The depressions 7 protrude from the top surface of the panel 5 down into the bottom thereof. The depression 7 on this bottommost panel 5 do not lock into anything. Referring to FIG. 3, it can be seen that the depressions 7 of the top panel 5 fit between the adjacent pylons of the tray 3 lying immediately beneath the panel 5. Several eggs 2 are shown in phantom outline in FIG. 3 to show how they fit in the trays 3. The bubble A in FIG. 3 shows how the buttons 9 on one tray 3 fit into a recess 10 in the top tray 3 overlying bottom tray 3.

Figure 4:
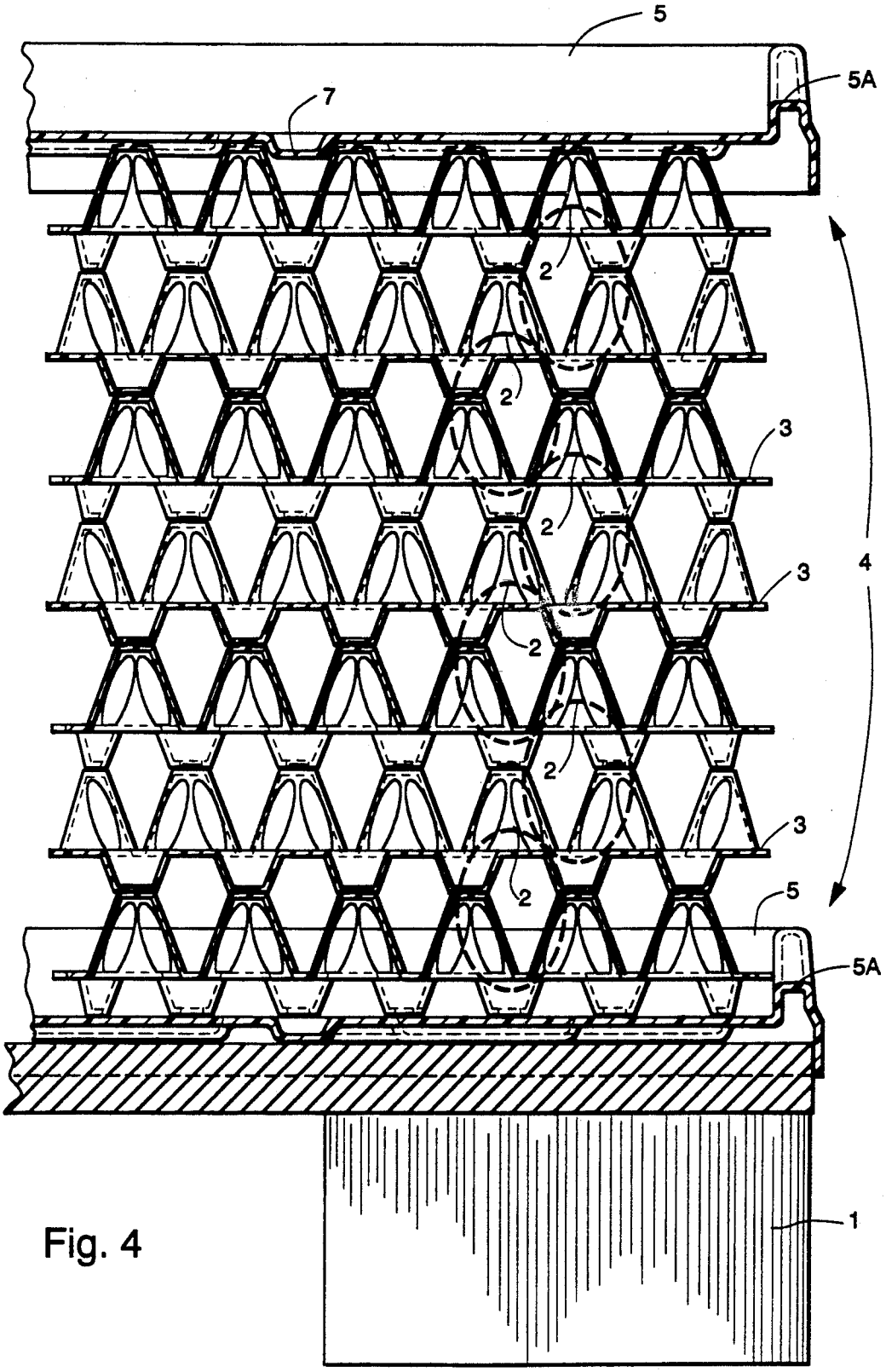
FIG. 4 shows seven trays mounted one on top another to form a stack, the stack lying between the panels of the present invention.

FIG. 4 is similar to FIG. 3 but taken on the line 4—4 of FIG. 2 showing the interlocking nature of the panel 5-tray 3 relationship at the top of the stack 4 from a direction 90 degrees rotated relative to FIG. 3. The depressions 7 in the panel 5 are shown as they appear rotated 90 degrees from FIG. 3. The eggs 2 are also shown in shadow outline in this FIG. 4.

Figure 5:
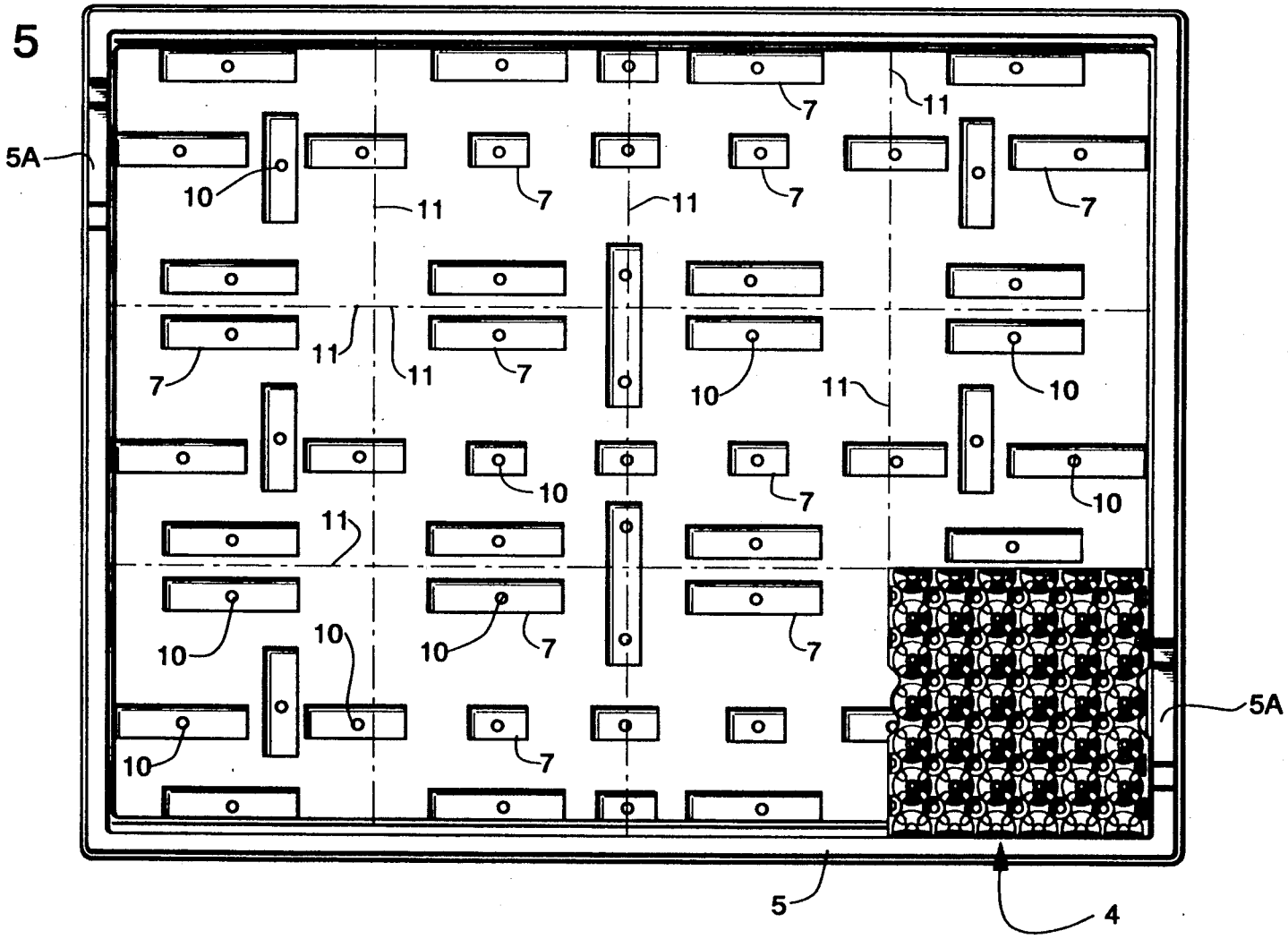
FIG. 5 shows a plan view of the panel of the present invention having a stack of trays in one corner thereof.

FIG. 5 is a plan view of the panel 5 showing the depressions 7 positioned to lock into the trays containing the eggs lying below this panel 5. Drainage holes 10 are shown in many of these depressions 7. These drainage holes 10 also serve to allow air to circulate through the entire shipping system. In one corner of this FIG. 5 is shown a stack 4 of trays 3. The remaining eleven stacks 4 are shown on this panel 5 in phantom outlines 11.

Referring back to FIG. 1, it can be seen that the panel 5 of the present invention succeeds in locking together a shipping system of over 10,000 loose eggs the better to withstand the exigencies of shipping and handling.

What we claim is:

1. In an egg-stacking system for improved safety in shipping eggs comprising a pallet and including a plurality of egg containing trays mounted one atop another to form a stack, a plurality of stacks of equal height positioned side by side to form an array, and a plurality of arrays separated one above the other by a panel, the improved panel comprising a high density synthetic plastic having raised edges to prevent a plurality of egg-containing trays from sliding on the panel, a plurality of depressions in the surface of the panel, said depressions being positioned to lie between rows of eggs in the trays below the panel to lock the panel and underlying stacks of eggs into a shift-resistant unit.

2. A panel according to claim 1 in which the depressions have at least one hole therein for drainage and ventilation.

3. A panel according to claim 1 made of rigid polyethylene.

4. A panel according to claim 1 having openings for hand holds on at least one of the edges thereof.

5. A panel according to claim 1 having depending lower edges to lock on said pallet.

* * * * *